US012239176B2

(12) United States Patent
Helten

(10) Patent No.: US 12,239,176 B2
(45) Date of Patent: Mar. 4, 2025

(54) GLOVE HOLDER

(71) Applicant: Nathan Helten, Garden Plain, KS (US)

(72) Inventor: Nathan Helten, Garden Plain, KS (US)

( * ) Notice: Subject to any disclaimer, the term of this patent is extended or adjusted under 35 U.S.C. 154(b) by 225 days.

(21) Appl. No.: 17/150,381

(22) Filed: Jan. 15, 2021

(65) Prior Publication Data

US 2022/0225707 A1 Jul. 21, 2022

(51) Int. Cl.
*A41D 19/00* (2006.01)

(52) U.S. Cl.
CPC ..... *A41D 19/0034* (2013.01); *A41D 2400/44* (2013.01)

(58) Field of Classification Search
CPC ..... A41D 19/0034; A41D 19/0037; A41D 19/041; A41D 19/0093; A41D 2400/44; A41D 2400/70; B65F 1/0013; B65F 1/002; B65F 2240/136; Y10S 224/933
USPC ..... 223/111; 224/194, 230, 269
See application file for complete search history.

(56) References Cited

U.S. PATENT DOCUMENTS 5,829,103 A * 11/1998 Allen ..... B43K 23/001 24/3.12
6,688,505 B1 * 2/2004 Bradley ..... A45F 5/06 224/932
9,392,862 B1 * 7/2016 Hajianpour ..... A45F 5/021
2007/0095991 A1 * 5/2007 Fall ..... A45F 5/02 248/229.26
2008/0190975 A1 * 8/2008 Naughton ..... A45F 5/02 15/210.1
2008/0191103 A1 * 8/2008 Thurgar ..... B65F 1/06 248/101
2011/0011906 A1 * 1/2011 Musgrave ..... A45F 5/02 224/269
2013/0254976 A1 * 10/2013 Aravena ..... F42B 39/02 224/183
2014/0061261 A1 * 3/2014 Yakeley ..... A63B 71/0036 224/183
2014/0305976 A1 * 10/2014 Stallworth ..... A45F 5/021 224/269
2015/0115008 A1 * 4/2015 Griffith ..... A45F 5/021 224/269
2018/0008032 A1 * 1/2018 Willows ..... A45F 3/005

* cited by examiner

*Primary Examiner* — Heather Mangine
*Assistant Examiner* — Matthew R Marchewka
(74) *Attorney, Agent, or Firm* — Stinson LLP

(57) ABSTRACT

A holder for a glove that includes a support arm and a catch arm. The support arm has first and second portions spaced apart along a longitudinal axis and an inner face that faces in a first direction along an axis perpendicular to the longitudinal axis. The catch arm has a first end portion connected to the first end portion of the support arm and a free second end portion spaced apart from the first end portion of the catch arm along the longitudinal axis. The catch arm has an inner face facing disposed in adjacent, face-to-face relationship with a portion of the inner face of the support arm such that the holder defines a glove retention area between the support arm and the catch arm. The holder grips a portion of a cuff of the glove in the glove retention area, retaining the glove.

22 Claims, 8 Drawing Sheets

GLOVE HOLDER

FIELD

The present disclosure generally relates to a holder for a glove, and more specifically, a holder for a glove that can receive a hand of a wearer without repositioning the glove on the holder.

BACKGROUND

When gloves are not being worn by a user, they are generally laid flat or wadded up inside a bag, within a pocket, on a shelf, or in a drawer.

BRIEF SUMMARY

In one embodiment, the present disclosure provides a holder for holding a work glove. The holder includes a support arm and a catch arm. The support arm has a first end portion and a second end portion spaced apart along a longitudinal axis such that the first end portion is spaced apart from the second end portion in a glove insertion direction along the longitudinal axis. The support arm also includes an inner face facing generally in first direction along an arm spacing axis perpendicular to the longitudinal axis. The catch arm has a first end portion connected to the first end portion of the support arm and a free second end portion spaced apart from the first end portion of the catch arm in a glove removal direction along the longitudinal axis. The glove removal direction is opposite the glove insertion direction. The catch arm has an inner face facing generally in a second direction that is opposite the first direction along the arm spacing axis. At least a portion of the inner face of the catch arm is disposed in adjacent, face-to-face relationship with at least a portion of the inner face of the support arm such that the holder defines the glove retention area between the support arm and the catch arm. The holder grips a portion of a cuff of the glove in the glove retention area between the support arm and the catch arm whereby the holder retains the glove.

BRIEF DESCRIPTION OF DRAWINGS

For a better understanding of the nature and objects of the disclosure, reference should be made to the following detailed description taken in conjunction with the accompanying drawings, in which.

Reference is made in the following detailed description of one or more embodiments to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim.

DETAILED DESCRIPTION

The inventor has recognized that conventional ways of storing gloves (e.g., work gloves) are not optimal for occupations that require the donning of gloves at a moment's notice. For instance, when firefighters are called upon, they must immediately don their gloves along with other protective gear. The conventional ways of storing gloves do not hold the gloves in a way that allows for them to be quickly put on. Further, the conventional ways of storing gloves often invite glove owners to wad the gloves up when not in use. Wadded gloves can sometimes become stiff, which complicates and delays the process of putting gloves on when called upon. Further, it is believed that wadded up gloves can retain moisture and thereby promote bacterial growth and/or other unsanitary conditions. Additionally, the inventor believes that it would be advantageous to provide a means for holding gloves on a person's body in a ready-to-wear condition so that the gloves can be quickly donned at a moment's notice. Therefore, there is a need for a glove holder that is time efficient and does not require additional handling of the gloves prior to putting the gloves on the hands of the wearer.

Figure 1:
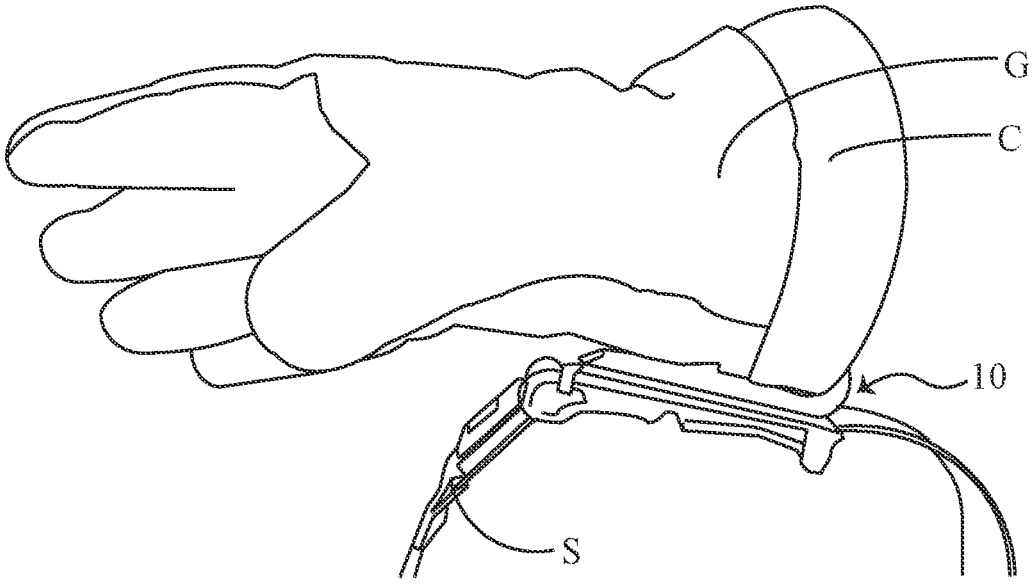
FIG. 1 is an illustration of the holder retaining a glove.
Figure 2:
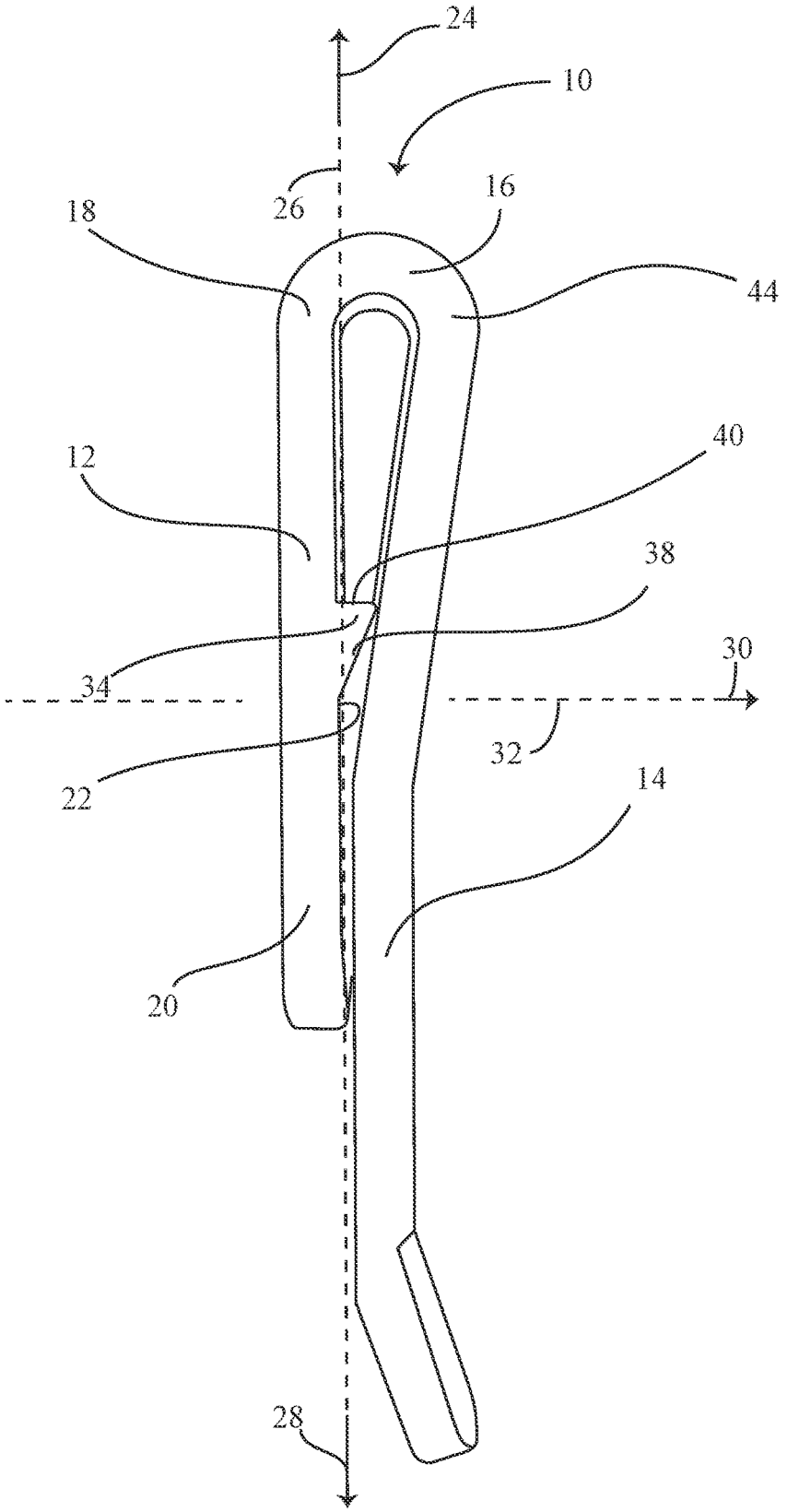
FIG. 2 is a side-view illustration of the holder.
Figure 3:
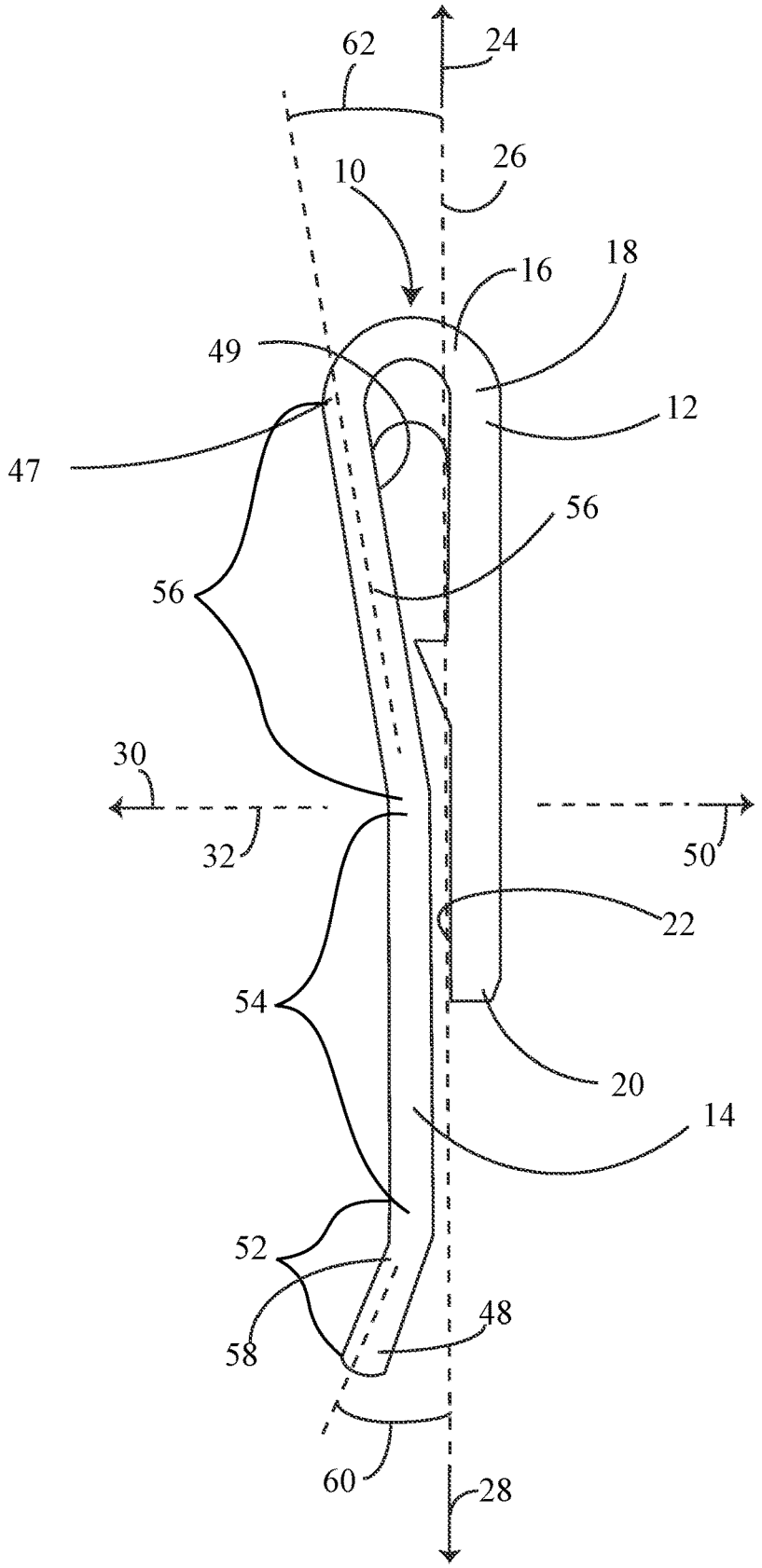
FIG. 3 is an alternative side-view illustration of the holder.

The present disclosure provides a holder 10 for a glove G, as shown in FIG. 1. The holder 10 includes a support arm 12 and a catch arm 14, as shown in FIGS. 2 and 3. In one or more embodiments, the holder 10 can further include a u-shaped portion 16 that extends between the support arm 12 and the catch arm 14. Further, in one or more embodiments, the holder 10 can be made from a single monolithic piece of material, continuously connecting the support arm 12 to the catch arm 14 through the U-shape portion. The holder 10 can be utilized for gripping a portion of a cuff C of the glove Gin a glove retention area between the support arm 12 and the catch arm 14. In certain embodiments, the glove retention area is defined by a region along the holder 10, between the support arm 12 and the catch arm 14, where the two arms come together in close (e.g., contacting) face-to-face relation. The glove retention area allows the holder 10 to retain the glove G such that the cuff C is partially open while a remainder of the glove hangs at least somewhat outstretched from the holder. By having the glove G hang somewhat outstretched, the glove on the holder 10 is ready, without adjustment, to receive a hand of a wearer. Further glove hangs so that it can air out, which is believed to promote sanitary conditions inside the glove.

As shown in FIG. 2, the support arm 12 of the present disclosure opposes at least a portion of the catch arm 14 and includes a first end portion 18, a second end portion 20, and an inner face 22. As shown, the first end portion 18 of the support arm 12 is spaced apart from the second end portion 20 of the support arm in a glove insertion direction 24 along a longitudinal axis 26. Conversely, the second end portion 20 of the support arm 12 is spaced apart from the first end portion 18 of the support arm along the longitudinal axis 26 in a glove removal direction 28, where the glove removal direction is opposite the glove insertion direction 24. As shown, the inner face 22 of the support arm 12 faces generally in a first direction 30 along an arm spacing axis 32 perpendicular to the longitudinal axis 26.

In some embodiments, the support arm 12 can further include a hook 34, as shown in FIG. 2. The hook 34 can protrude from the inner face 22 of the support arm 12 toward the catch arm 14 such that it may further retain the cuff C of the glove G, as shown in FIG. 1. By further retaining the cuff C of the glove G, as shown in FIG. 1, the glove does not fall off the holder 10 when the holder is nonstationary. In one or more embodiments, the hook 34 is, for example but not limiting to, a triangular protrusion. The hook 34 can force the cuff C of the glove G to bend as it clears the hook, allowing the hook to hook or engage fabric of the glove in a way that provides resistance to inadvertent movement or withdrawal of the glove in the glove removal direction 28. As shown, the hook 34 can include a ramped end 38 and a hooking end 40. The ramped end 38 faces the glove removal direction 28 while the hooking end 40 faces the glove insertion direction 24. As shown, the ramped end 38 is angled such that the ramped end extends in the first direction 30 along the arm spacing axis 32 while extending longitudinally in the glove insertion direction 24. In accordance with the present disclosure, the hooking end 40 can be either substantially generally perpendicular to the longitudinal axis 26 or, in another embodiment (not shown), angled such that the hooking end extends in the first direction 30 along the arm spacing axis 32 while extending longitudinally in the glove insertion direction 24.

Figure 4:
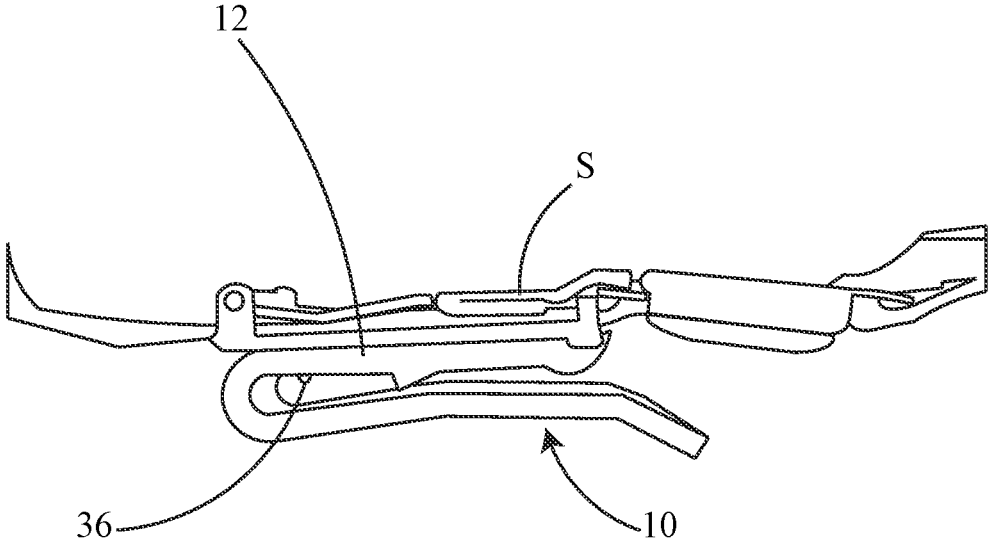
FIG. 4 is an illustration of the holder being releasably fastened to a separate support structure by a fastener.
Figure 5:
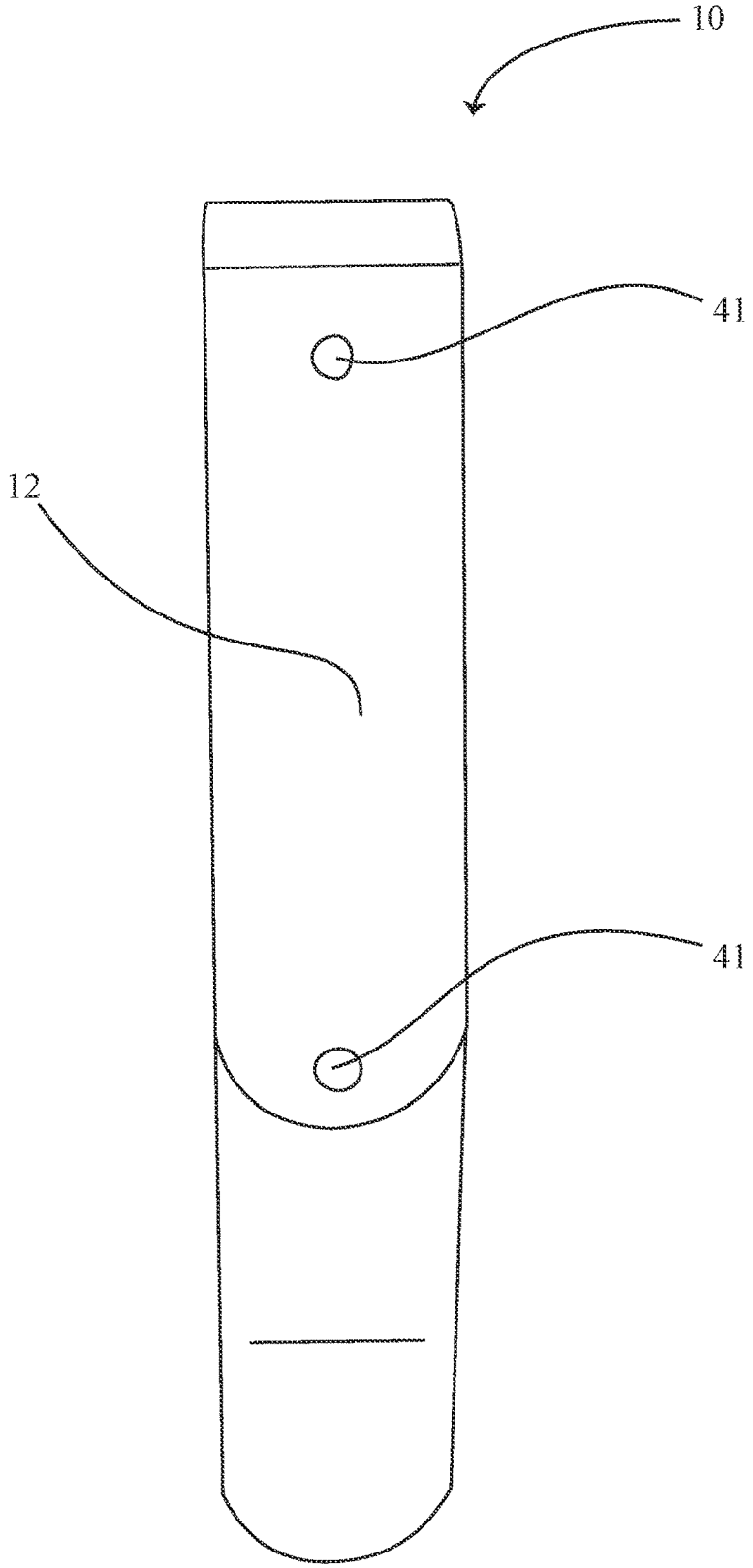
FIG. 5 is a back-view illustration of the holder including fastener receivers.

As shown in FIGS. 4 and 5, the holder 10 comprises a fastener 36 for releasably fastening the support arm 12 to a separate support structure S for supporting the holder on the separate support structure. As shown in FIG. 5, the illustrated support arm 12 comprises fastener receivers 41 for receiving removable fasteners 36 (e.g., screws) therethrough. As shown in FIG. 4, the fasteners 36 can extend through fastener receivers 41 into the support structure S for fastening the holder 10 to the support structure. In FIGS. 1 and 4, the support structure S is a belt to be worn around a person's waist. Thus, the support arm 12 and fasteners 36 mount the holder 10 on the person so that the holder moves with the person when the belt is worn. This allows the holder 10 to support the gloves on the person in a ready-to-wear condition. As one would understand, location, type, and shape of the fastener receivers can vary to correlate with the type of fastener 36. Further, the separate support structure S could be other than a belt, e.g., another article of clothing, a stationary article such as a wall, or nonstationary article such as a backpack.

Figure 6:
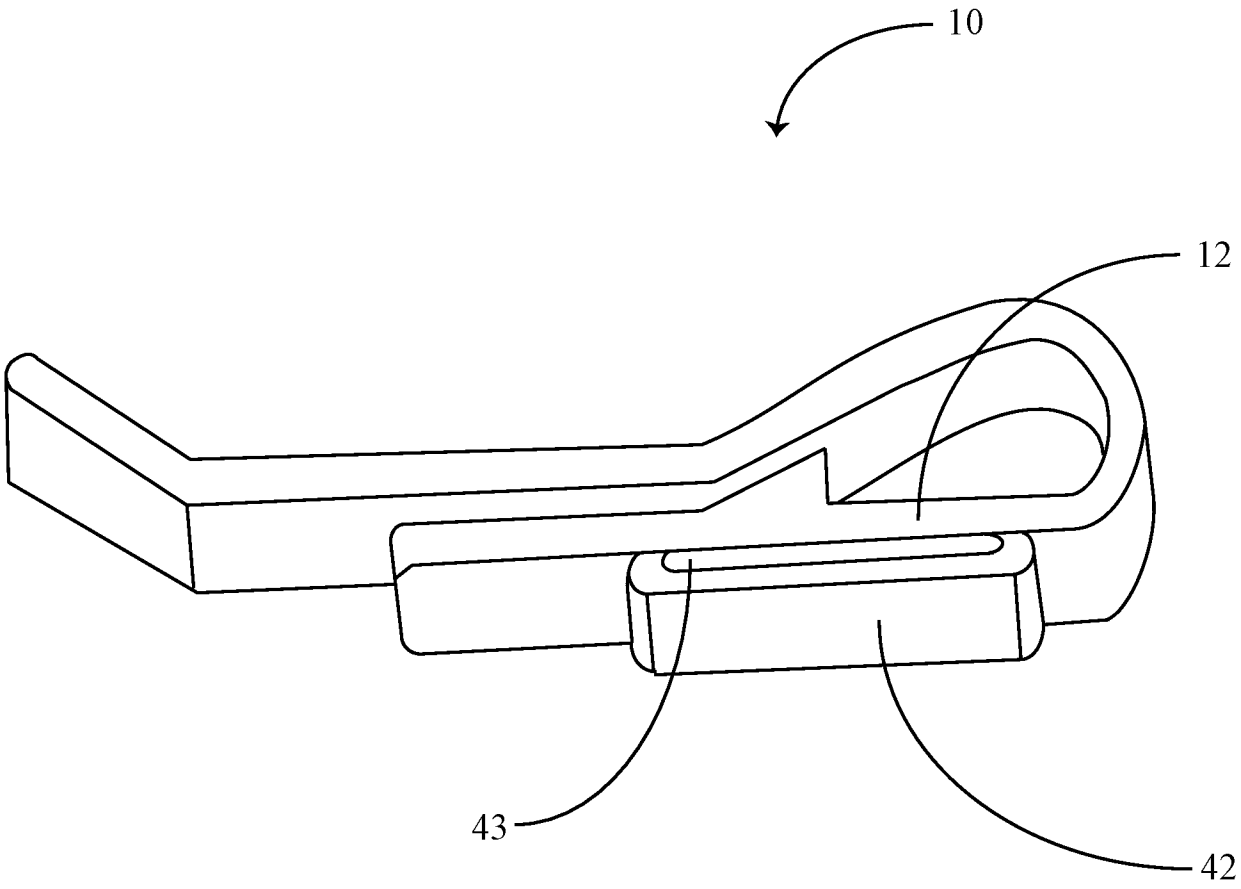
FIG. 6 is an illustration of an alternative embodiment of the glove holder with a belt loop for mounting the holder.

In an alternative embodiment, as shown in FIG. 6, the holder 10 can include a loop 42 on the support arm 12 for mounting the holder 10, e.g., as an alternative to the holder including fastener receivers 41 and fasteners 36, as shown in FIGS. 4 and 5. As shown in FIG. 6, the belt loop 42 on the support arm defines a passage 43 for receiving a portion of a belt (not shown) to support the holder 10 on the belt.

Figure 7:
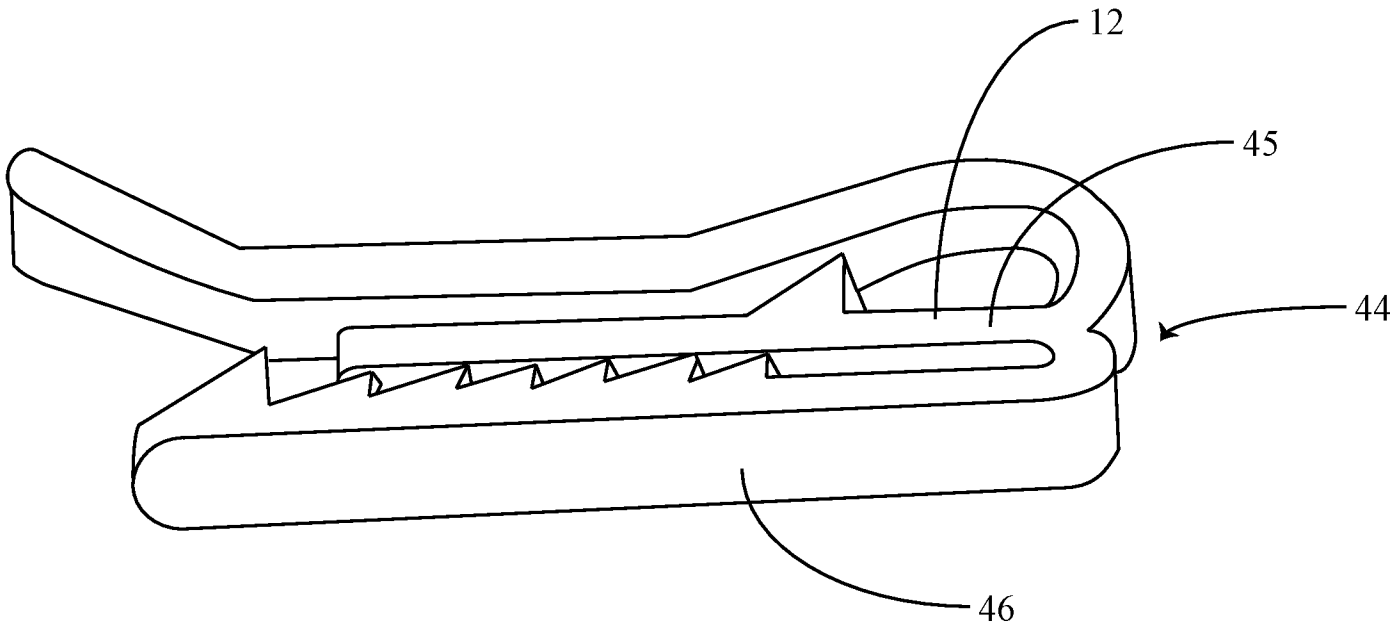
FIG. 7 is an alternative illustration of an alternative embodiment of the glove holder with an integrated clip for mounting the holder.

Alternatively, as shown in FIG. 7, the support arm 12 of the holder 10 can include an integrated clip 44 for mounting the holder or a support structure. As shown, the illustrated support arm 12 comprises first and second arm portions 45, 46 that together define the clip 44 for securing the holder 10 to a fabric edge margin (e.g., a pocket or a belt). As sown in FIG. 7, the second support arm portion 46 can be toothed so that the first arm portion 45 of the support arm and the second arm portion grip the fabric edge margin received therebetween.

As shown in FIG. 3, in the preferred embodiment, the catch arm 14 of the holder 10 includes a first end portion 47, a free second end portion 48, and an inner face 49. The U-shaped portion 16 of the holder 10 connects the first end portion 47 of the catch arm 14 to the first end portion 18 of the support arm 12. The free second end portion 48 of the catch arm 14 is spaced apart from the first end portion 47 of the catch arm in the glove removal direction 28 along the longitudinal axis 26. In one or more embodiments, the free second end portion 48 of the catch arm 14 protrudes along the longitudinal axis 26 in the glove removal direction beyond the tip of the support arm 12. For example, the free second end portion 48 of the catch arm 14 can protrude longitudinally beyond the tip of the second end portion 20 of the support arm 12 by at least 0.5 inches (e.g., at least 1.0 inches). The protruding second end portion 48 of the catch arm 14 can catch the cuff C of the glove G as the glove moves proximal-end-first toward the holder 10 in the glove insertion direction 24, as illustrated in FIGS. 1 and 3. In the illustrated embodiment, the cuff C defines the proximal end of the glove G and the fingertips define the opposite distal end of the glove. The inner face 49 of the catch arm 14 faces generally in a second direction 50 along the arm spacing axis 32, where the second direction is oppositely facing the first direction 30. Further, at least a portion of the inner face 49 of the catch arm 14 is disposed in adjacent, face-to-face relationship with at least a portion of the inner face 22 of the support arm 12 such that the holder 10 can define the glove retention area between the support arm 12 and the catch arm 14. The catch arm 14 in one or more embodiments, is configured to guide the portion of the cuff C into the glove retention area as the glove G moves proximal-end-first along the holder 10 after the free second end portion 48 of the catch arm catches the cuff of the glove.

Figure 8:
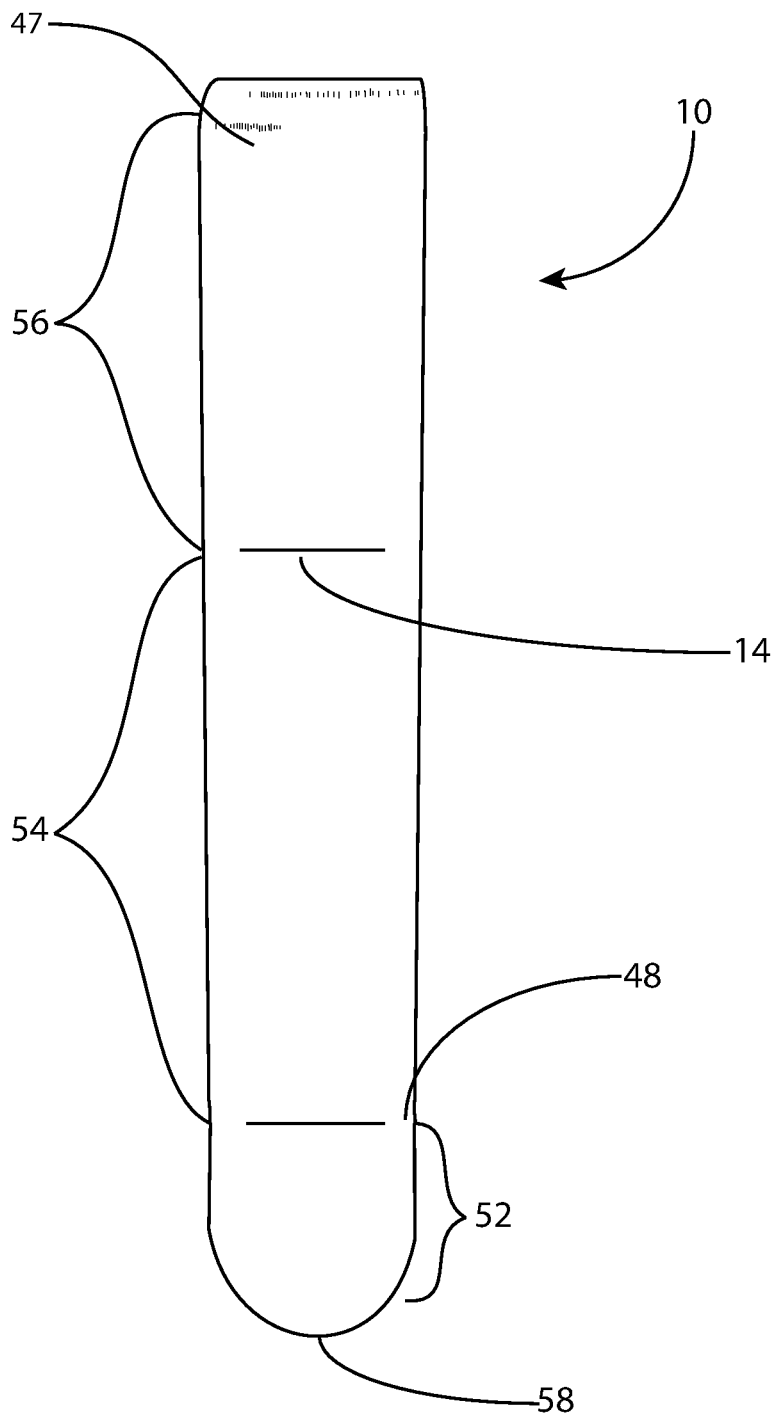
FIG. 8 is a front-view of the holder.

As shown in FIGS. 3 and 8, in one or more embodiments, the catch arm 14 further includes a flared section 52 that defines the free second end portion 48, a tapering section 56 that defines the first end portion 47, and a longitudinally extending middle section 54 between the flared section 52 and the tapering section 56. The flared section 52 includes a first end 58 joined to the middle section 54. The flared section 52 extends longitudinally from the first end 58 to the free second end portion 48 of the catch arm 14 in the glove removal direction 28. Further, the flared section 52 is angled to extend in the first direction 30 along the arm spacing axis 32 as it extends longitudinally from the first end 58 of the flared section 52 to the free second end portion 48 of the catch arm 14. The flared section 52 defines a flare angle 60 between the flared section and the longitudinal axis 26. In one or more embodiments, the flare angle 60 is in an inclusive range of from about 10° to about 70° (e.g., from about 15° to about 45°). The fared section 60 forms an outwardly protruding catch that allows a user to easily guide the cuff C of the glove G into the glove retention area of the holder 10.

The middle section 54 is spaced apart between the first end portion 47 of the catch arm 14 and the free second end portion 48 of the catch arm 14. As shown, the middle section 54 is oriented substantially parallel to the longitudinal axis 26. In one or more embodiments, as shown, the middle section 54 is longer than the flared section 52. A portion of the illustrated middle section 54 opposes the second end portion 20 of the support arm 12 in close, face-to-face relation. Thus, the middle section 54 defines a portion of the glove retention area, e.g., a portion of the glove can be retained (e.g., clipped, gripped, or pinched) between the opposing portions of the middle section and the support arm 12.

In the illustrated embodiment, the tapering section 56 that extends longitudinally from the first end portion 47 of the catch arm 14 to the middle section 54 of the catch arm. The tapering section 56 is angled to extend in the second direction 50 along the arm spacing axis 32 as it extends longitudinally from the first end portion 47 of the catch arm 14 to the middle section 54. As shown in FIG. 3, the tapering section 56 defines a taper angle 62 between the tapering section and the longitudinal axis 26 that is less than the flare angle 60 of the flared section 52. In one or more embodiments, the taper angle 62 is less than the flare angle 60. In certain embodiments, the taper angle is in an inclusive range of from about 5° to about 45° (e.g., from about 10° to about 40°). A portion of the illustrated tapering section 56 opposes the second end the ramped end 38 of the hook 34 in close, face-to-face relation. Thus, the tapering section 56 defines a portion of the glove retention area, e.g., a portion of the glove can be retained (e.g., clipped, gripped, or pinched) between the opposing portions of the tapering section and the hook 34.

In an exemplary embodiment, the main body of the holder 10, which includes the support arm 12, the catch arm 14, and the U-shaped portion 16, is formed from a single piece of monolithic material. Suitably, the material is resiliently bendable. This enables the u-shaped portion 16 to resiliently bend to allow the catch arm 14 to move away from the support arm 12 along the arm spacing axis 32, which opens the holder 10 for receiving the glove G. When the force used to separate the catch arm 14 from the support arm 12 is released, the U-shaped portion resiliently rebounds to return the holder to the closed position shown in the drawings. In certain embodiments (not shown), the holder 10 can include additional retention features for retaining the holder in the closed position when the glove G is in place.

Various materials can be used to form the main body of the holder 10 without departing from the scope of the disclosure. For instance, in one or more embodiments, the holder 10 of the present disclosure is formed from Acrylonitrile butadiene styrene (ABS), or another thermoplastic polymer. Other suitable materials include Ultem (polyetherimide) and tempered metals. As one skilled in the art would understand, the material used for the holder 10 can withstand a variety of environmental conditions based off their material properties correlating with the material.

An exemplary method of using the holder 10 will now be briefly described. In certain embodiments, two holders 10 are secured to a garment such as the belt S using suitable fasteners. In these embodiments, a separate holder is provided for the glove of each hand of the wearer. The holders 10 are mounted on the belt S so that the support arm 12 is located close to the body and the catch arm 14 is disposed outboard of the support arm. In an exemplary embodiment, the holders 10 are mounted so that the two holders are located on opposite lateral sides of the body, with the catch arms 14 pointing somewhat laterally inward toward the navel. Other positions and orientations are also contemplated within the scope of the disclosure.

A user wearing gloves G can place the gloves on the holders 10 by drawing the gloves proximal-end-first toward the holders. For each glove G, the flared section 52 of the catch arm 14 will catch the cuff C, and the inner surface 49 of the catch arm will then guide the cuff in the glove insertion direction 24 toward the glove retention area. A portion of the cuff C will pass into the glove retention area—the space between the opposing inner surfaces 22, 49. A portion of the cuff will pass longitudinally over the hook 34, into the enlarged space provided by the tapering section 56 of the catch arm. Fabric of the cuff C can bunch up inside this enlarged space after passing over the hook 34. Engagement of the cuff C with the U-shaped portion 16 will stop movement of the glove G, causing the cuff to slip of the user's hand. (It will be appreciated that the glove G can also be installed in the holder 10 when it is not being worn using essentially the same steps.) It can be seen that the holder 10 enables doffing of each glove with a simple movement of the gloved hand toward and along the holder, and this simple causes the glove to be supported in ready-to-wear condition.

Once the glove G is positioned on the holder 10, the hooking end 40 of the hook 34 opposes a portion of the cuff C to resist unintended pullout of the glove. Further, a portion of the glove G is gripped between the ramped end 38 of the hook and the opposing portion of the tapering section 56, as well as between the middle section 54 of the catch arm 14 and the opposing portion of the support arm 12. The holder 10 thus retains the glove G such that cuff C is partially open and a remainder of the glove hangs at least somewhat outstretched from the holder. This positions the glove G so that it is ready, without adjustment, for receiving the hand of a wearer.

When duty requires use of the gloves G held by the holders H, the user simply places hands into the partially open cuffs C of the gloves suspended from the holders. The positioning of the gloves held by the holders H prevents the fingers or palm region from wadding—instead they remain somewhat open—so that the user's hand can easily slip into place. As the user continues to move the hands in the distal direction, the hands will naturally tend to sweep in the direction 30 along the arm spacing axis 32. This will cause the holder 10 to open, releasing the glove G from the hook 34. The fluid, sweeping movement of the hands thus moves the gloves G out of the holders 10 in the glove removal direction 28. The holders 10 thus enable donning of each glove with a clean, efficient, one-handed motion.

The foregoing description has been presented for the purposes of illustration and description. It is not intended to be exhaustive or to limit the disclosure to the precise form disclosed. Many modifications and variations are possible in view of this disclosure. Indeed, while certain features of this disclosure have been shown, described and/or claimed, it is not intended to be limited to the details above, since it will be understood that various omissions, modifications, substitutions and changes in the apparatuses, forms, method, steps and system illustrated and, in its operation, can be made by those skilled in the art without departing in any way from the spirit of the present disclosure.

Furthermore, the foregoing description, for purposes of explanation, used specific nomenclature to provide a thorough understanding of the disclosure. However, it will be apparent to one skilled in the art that the specific details are not required in order to practice the disclosure. Thus, the foregoing descriptions of specific embodiments of the present disclosure are presented for purposes of illustration and description. They are not intended to be exhaustive or to limit the disclosure to the precise forms disclosed, many modifications and variations are possible in view of the above teachings. The embodiments were chosen and described in order to best explain the principles of the disclosure and its practical applications, to thereby enable others skilled in the art to best utilize the disclosed system and method, and various embodiments with various modifications as are suited to the particular use contemplated.

What is claimed is:

1. A holder for holding a work glove, the holder comprising:

a support arm, the support arm having a first end portion and a second end portion spaced apart along a longitudinal axis, the first end portion being spaced apart from the second end portion in a glove insertion direction along the longitudinal axis, the support arm having an inner face facing generally in a first direction along an arm spacing axis perpendicular to the longitudinal axis;

a catch arm having a first end portion connected to the first end portion of the support arm and a free second end portion spaced apart from the first end portion of the catch arm in a glove removal direction along the longitudinal axis, the glove removal direction being opposite the glove insertion direction, the catch arm having an inner face facing generally in a second direction along the arm spacing axis, the second direction being opposite the first direction, at least a portion of the inner face of the catch arm being disposed in adjacent, face-to-face relationship with at least a portion of the inner face of the support arm such that the holder defines a glove retention area between the support arm and the catch arm, the holder being configured to grip a portion of a cuff of the work glove in the glove retention area between the support arm and the catch arm whereby the holder retains the work glove; and a single hook protruding from the inner face of the support arm toward the catch arm, wherein the single hook is configured to grip a portion of the work glove;

wherein the single hook is located along the longitudinal axis nearer to the first end portion of the catch arm than the free second end portion of the catch arm, wherein the inner face of the support arm comprises a first segment extending from the single hook to the first end portion of the support arm, and a second segment extending from the single hook to the second end portion of the support arm, wherein the first segment and the second segment of the inner face of the support arm are flat.

2. The holder as set forth in claim 1, wherein the free second end portion of the catch arm is configured to catch the cuff of the work glove as the work glove moves proximal-end-first toward the holder in the glove insertion direction.

3. The holder as set forth in claim 2, wherein the catch arm is configured to guide a portion of the cuff into the glove retention area as the work glove moves proximal-end-first along the holder after the free second end portion of the catch arm catches the cuff of the work glove.

4. The holder as set forth in claim 1, wherein the catch arm comprises a flared section that has a first end and extends longitudinally from the first end of the flared section to the free second end portion of the catch arm in the glove removal direction, the flared section being angled to extend in the first direction along the arm spacing axis as the flared section extends longitudinally from the first end to the free second end portion.

5. The holder as set forth in claim 4, wherein the catch arm further comprises a middle section extending longitudinally between the first end portion of the catch arm and the free second end portion of the catch arm, the middle section being oriented substantially parallel to the longitudinal axis.

6. The holder as set forth in claim 5, wherein the catch arm further comprises a tapering section, the tapering section extending longitudinally from the first end portion of the catch arm to the middle section, the tapering section being angled to extend in the second direction along the arm spacing axis as the tapering section extends longitudinally from the first end portion of the catch arm to the middle section.

7. The holder as set forth in claim 6, wherein the tapering section is longer than the middle section and the middle section is longer than the flared section.

8. The holder as set forth in claim 6, wherein the tapering section defines a taper angle between the tapering section and the longitudinal axis and the flared section defines a flare angle between the flared section and the longitudinal axis, the flare angle being greater than the taper angle.

9. The holder as set forth in claim 1, wherein the single hook comprises a ramped end facing in the glove removal direction and a hooking end facing in the glove insertion direction, the ramped end being angled such that the ramped end extends in the first direction along the arm spacing axis as the ramped end extends longitudinally in the glove insertion direction.

10. The holder as set forth in claim 9, wherein the hooking end is substantially perpendicular to the longitudinal axis.

11. The holder as set forth in claim 1, wherein the catch arm comprises a tapering section adjacent the first end portion of the catch arm, the tapering section being angled to extend in the second direction along the arm spacing axis as the tapering section extends longitudinally from the first end portion of the catch arm in the glove removal direction.

12. The holder as set forth in claim 11, wherein the single hook opposes the tapering section of the catch arm.

13. The holder as set forth in claim 1, further comprising a U-shaped portion extending between the first end portion of the support arm and the first end portion of the catch arm.

14. The holder as set forth in claim 13, wherein the holder is formed from a single monolithic piece of material.

15. The holder as set forth in claim 14, wherein the U-shaped portion of the holder is resiliently bendable to allow the catch arm to move away from the support arm along the arm spacing axis.

16. The holder as set forth in claim 1, further comprising a fastener for releasably fastening the support arm to a separate support structure for supporting the holder on the separate support structure.

17. The holder as set forth in claim 1, wherein the holder is configured to retain the work glove such that the cuff is partially open and a remainder of the work glove hangs at least somewhat outstretched from the holder so that the work glove is ready, without adjustment, for receiving a hand of a wearer.

18. The holder as set forth in claim 1, wherein the holder is formed of plastic or metal.

19. The holder as set forth in claim 1, wherein the catch arm is longer than the support arm.

20. A holder for holding a work glove, the holder comprising:

a support arm, the support arm having a first end portion and a second end portion spaced apart along a longitudinal axis, the first end portion being spaced apart from the second end portion in a glove insertion direction along the longitudinal axis, the support arm having an inner face facing generally in a first direction along an arm spacing axis perpendicular to the longitudinal axis; and a catch arm having a first end portion connected to the first end portion of the support arm and a free second end portion spaced apart from the first end portion of the catch arm in a glove removal direction along the longitudinal axis, the glove removal direction being opposite the glove insertion direction, the catch arm having an inner face facing generally in a second direction along the arm spacing axis, the second direction being opposite the first direction, at least a portion of the inner face of the catch arm being disposed in adjacent, face-to-face relationship with at least a portion of the inner face of the support arm such that the holder defines a glove retention area between the support arm and the catch arm, the holder being configured to grip a portion of a cuff of the work glove in the glove retention area between the support arm and the catch arm whereby the holder retains the work glove;

wherein the catch arm comprises a flared section that has a first end and extends longitudinally from the first end of the flared section to the free second end portion of the catch arm in the glove removal direction, the flared section being angled to extend in the first direction along the arm spacing axis as the flared section extends longitudinally from the first end to the free second end portion;

wherein the catch arm comprises a spacing portion that extends between the second end portion of the support arm and the first end of the flared section, the spacing portion being oriented substantially parallel to the longitudinal axis;

wherein the free second end portion of the catch arm is spaced apart from the second end portion of the support arm along the longitudinal axis by the spacing portion, such that the catch arm protrudes in relation to the support arm in the glove removal direction.

21. A holder for holding a work glove, the holder comprising:

a support arm, the support arm having a first end portion and a second end portion spaced apart along a longitudinal axis, the first end portion being spaced apart from the second end portion in a glove insertion direction along the longitudinal axis, the support arm having an inner face facing generally in a first direction along an arm spacing axis perpendicular to the longitudinal axis;

a catch arm having a first end portion and a free second end portion spaced apart from the first end portion of the catch arm in a glove removal direction along the longitudinal axis, the glove removal direction being opposite the glove insertion direction, the catch arm having an inner face facing generally in a second direction along the arm spacing axis, the second direction being opposite the first direction, at least a portion of the inner face of the catch arm being disposed in adjacent, face-to-face relationship with at least a portion of the inner face of the support arm such that the holder defines a glove retention area between the support arm and the catch arm, the holder being configured to grip a portion of a cuff of the work glove in the glove retention area between the support arm and the catch arm whereby the holder retains the work glove;

a U-shaped portion extending from the first end portion of the support arm to the first end portion of the catch arm;

a single hook protruding from the inner face of the support arm toward the catch arm, wherein the single hook is configured to grip a portion of the work glove;

wherein the single hook is located along the longitudinal axis nearer to the first end portion of the catch arm than the free second end portion of the catch arm;

wherein the single hook comprises a ramped end facing in the glove removal direction and a hooking end facing in the glove insertion direction;

wherein the inner face of the support arm comprises a first segment extending from the hooking end of the single hook to a location where the first end portion merges into the U-shaped portion and the U-shaped portion begins to turn toward the catch arm;

wherein the inner face of the support arm further comprises a second segment extending from the ramped end to the second end portion of the support arm;

wherein the first segment and the second segment of the inner face of the support arm are flat.

22. The holder of claim 21, wherein the holder is devoid of protrusions on the first segment and the second segment of the inner face of the support arm.

* * * * *